US007664408B2

(12) United States Patent
Watanabe et al.

(10) Patent No.: US 7,664,408 B2
(45) Date of Patent: Feb. 16, 2010

(54) IMAGE-FORMING APPARATUS, CONTROL METHOD THEREOF, AND CONTROL PROGRAM STORING MEDIUM FOR IMAGE-FORMING APPARATUS

(75) Inventors: Toshio Watanabe, Kanagawa (JP); Tomohisa Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 274 days.

(21) Appl. No.: 11/687,788

(22) Filed: Mar. 19, 2007

(65) Prior Publication Data

US 2008/0013966 A1 Jan. 17, 2008

(30) Foreign Application Priority Data

Jul. 12, 2006 (JP) ..... 2006-191126

(51) Int. Cl.
*G03G 15/00* (2006.01)

(52) U.S. Cl. ..... 399/12

(58) Field of Classification Search ..... 399/12, 399/24, 25, 26, 27

See application file for complete search history.

(56) References Cited

U.S. PATENT DOCUMENTS

2006/0127105 A1* 6/2006 Lee ..... 399/12

FOREIGN PATENT DOCUMENTS

JP 2002333800 11/2002

* cited by examiner

*Primary Examiner*—Hoang Ngo
(74) *Attorney, Agent, or Firm*—Gauthier & Connors LLP

(57) ABSTRACT

An image-forming apparatus in which a replacement part is loaded includes a discrimination unit that discriminates whether or not identification data registered in the loaded replacement part correspond to either inherent data or group data registered in the image-forming apparatus; a determination unit that, when no correspondence is found in the discrimination unit, determines in accordance with a registration condition whether or not a value of the identification data is registered as the group data; and an establishment unit that establishes approval or disapproval of use of the loaded replacement part on the basis of a result of discrimination performed in the discrimination unit or determination performed in the determination unit.

16 Claims, 6 Drawing Sheets

IMAGE-FORMING APPARATUS, CONTROL METHOD THEREOF, AND CONTROL PROGRAM STORING MEDIUM FOR IMAGE-FORMING APPARATUS

CROSS-REFERENCE TO RELATED APPLICATIONS

This application is based on and claims priority under 35 USC 119 from Japanese Patent Application No. 2006-191126 filed on Jul. 12, 2006.

BACKGROUND

1. Technical Field

The present invention relates to a technology for controlling whether or not to enable use of a replacement part loaded in an image-forming apparatus.

2. Related Art

An image-forming apparatus such as a printer or a copier performs printing while replacement parts, such as a toner cartridge, a drum, and a heating roller, are attached thereto. In general, such replacement parts can be attached to any image-forming apparatus of the same type.

SUMMARY

According to an aspect of the invention, there is provided an image-forming apparatus in which a replacement part is loaded, including a discrimination unit that discriminates whether or not identification data registered in the loaded replacement part correspond to inherent data or group data registered in the image-forming apparatus; a determination unit that, when no correspondence is found in the discrimination unit, determines, in accordance with a registration condition, whether or not a value of the identification data is registered as the group data; and an establishment unit that establishes approval or disapproval of use of the loaded displacement part on the basis of a result of discrimination performed in the discrimination unit or determination performed in the determination unit.

BRIEF DESCRIPTION OF THE DRAWINGS

Exemplary embodiments of the present invention will be described in detail by reference to the following figures, wherein.

DETAILED DESCRIPTION

Figure 1:
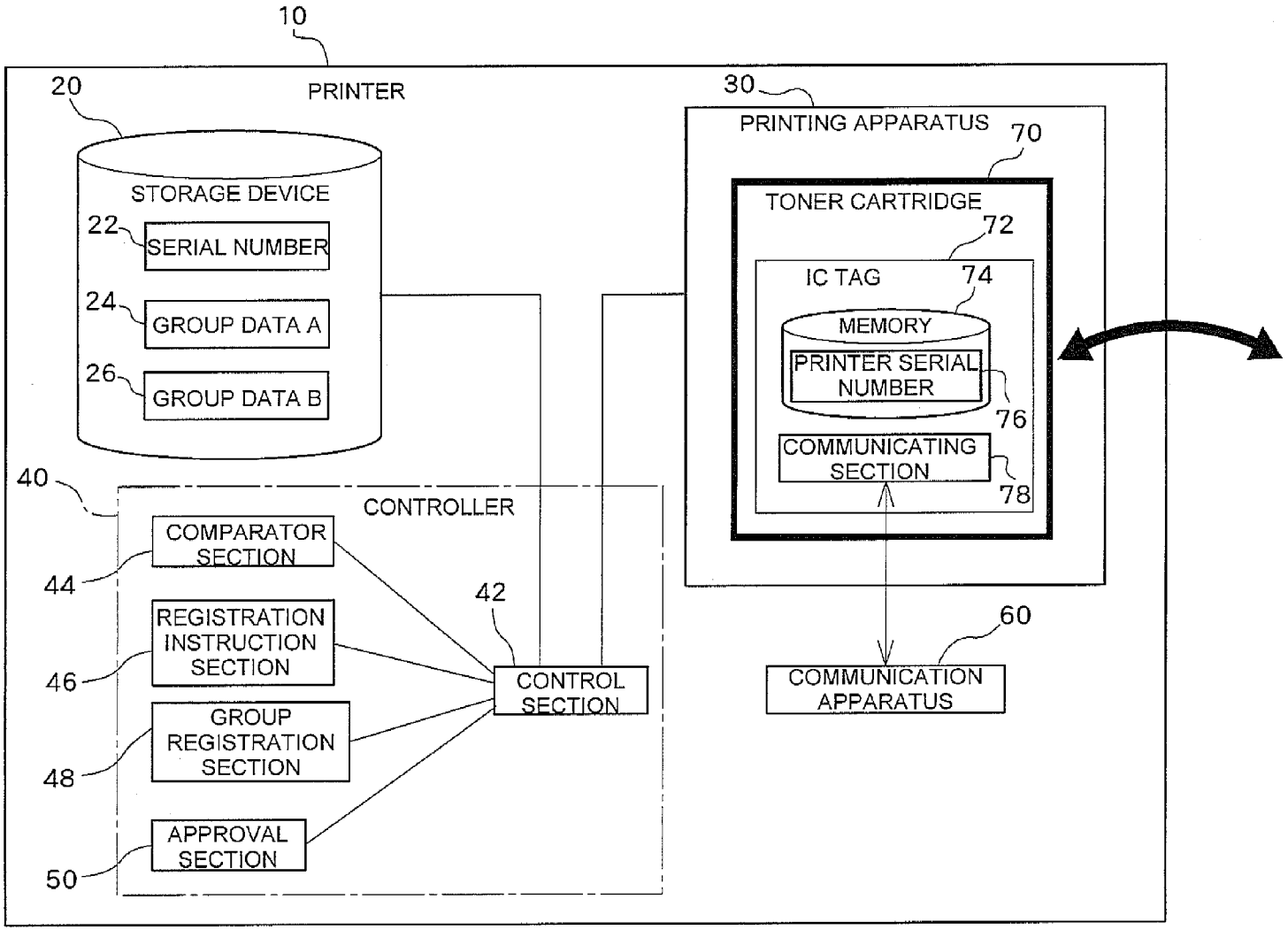
FIG. 1 is a block diagram schematically showing an example configuration of a printer and a toner cartridge.

FIG. 1 is a block diagram schematically showing a configuration of a printer 10 which is one example of an image-forming apparatus. The printer 10 includes, as primary components, a storage device 20, a printing apparatus 30, a controller 40, and a communication apparatus 60.

The storage device 20 is configured from a semiconductor memory or the like, and stores a serial number 22 of the printer 10, group data A 24, and group data B 26 in addition to various data items. The serial number 22, which is data inherent in the printer 10 and assigned during the course of manufacture of the printer 10, cannot be overwritten by a user. The group data A 24 and the group data B 26 are serial numbers of image-forming apparatus which can share the use of replacement parts with the printer 10, and are not assigned values during the course of manufacture of the printer 10. In view that no value is specified in these group data A 24 and B 26 during the course of manufacture of the printer 10, values are to be input in accordance with a condition at a later time or are to be overwritten.

The printing apparatus 30 is adapted to perform xerographic printing on paper. In FIG. 1, a toner cartridge 70 is depicted as one example of a replacement part to be loaded in the printing apparatus 30. The toner cartridge 70 is usually replaced upon depletion thereof, or in some cases might be replaced even through toner still remains therein. As a newly-loaded toner cartridge 70, various toner cartridges including those unused, those previously attached to the printer 10, and those previously used in another printer are considered.

The toner cartridge 70 has an IC tag 72 attached thereto. The IC tag 72 is a device including a memory 74, such as a ROM or a RAM, and a communication section 78 for implementing wireless communication. The memory 74 stores a printer serial number 76 in addition to programs or various data items. As data for identifying a printer that uses the toner cartridge 70, a serial number of the printer is entered into the printer serial number 76.

The controller 40 is a computer such as a microprocessor configured from hardware having an arithmetic capability and software (a software program) for controlling operation of the hardware. The controller 40 has installed therein a control section 42, a comparator section 44, a registration instruction section 46, a group registration section 48, and an approval section 50. The control section 42 manages both operation of each component and data communication while controlling the storage device 20, the printing apparatus 30, and the communication apparatus 60.

The comparator section 44 compares the printer serial number 76 of the loaded toner cartridge 70 with the serial number 22, the group data A 24, and the group data B 26 stored in the storage device 20, in order to determine whether or not correspondence exists therebetween.

When the printer serial number 76 has no value assigned thereto; in other words, when the toner cartridge 70 is brand-new, the registration instruction section 46 assigns a value of the serial number 22 to the printer serial number 76. In addition, when the printer serial number 76 corresponds to either the group data A 24 or the group data B 26; i.e., the printer 10 is allowed to use the toner cartridge 70 while there is another printer which can use the toner cartridge 70, the registration instruction section 46 may also assign the value of the serial number 22 to the printer serial number 76.

On the other hand, when the printer serial number 76 does not correspond to any one of the serial number 22, the group data A 24, and the group data B 26, and one or both of the group data A 24 or the group data B 26 have no assigned value, the group registration section 48 assigns a value of the printer serial number 76 to the group data A 24 or the group data B 26 having no assigned value. Further, the value of the printer serial number 76 may be assigned to the group data A 24 or the group data B 26 having an assigned value when an overwrite-allowing condition is satisfied. As one example of the overwrite-allowing condition, there may be defined a condition in which the toner cartridge 70 having the printer serial number 76 corresponding to either the group data A 24 or the group data B 26 is not attached for a predetermined time period after specification of the group data A 24 or the group data B 26. The overwrite-allowing condition as described above may be adopted when new grouping cannot be performed because of saturation of the group data A 24 or the group data B 26.

The approval section 50 enables use of the toner cartridge 70 when the comparator section 44 determines that the printer serial number 76 corresponds to any one of the serial number 22, the group data A 24, and the group data B 26. On the other hand, when no correspondence is determined, use of the toner cartridge 70 is disabled. However, use of the toner cartridge 70 which is initially disabled is enabled if and when correspondence with the toner cartridge 70 is established through processing performed by the registration instructing section 46 or the group registration section 48.

In a case where replacement parts other than the toner cartridge 70 are additionally attached to the printing apparatus 30, the controller 40 may collectively manage the replacement parts together with the toner cartridge 70, or may manage thee replacement parts similarly but independently of the toner cartridge 70.

The communication apparatus 60 communicates with the communication section 78 in the IC tag 72 under the control of the controller 40. The communication apparatus 60 and the communication section 78 have respective antennas for establishing wireless communication.

Next, by reference to FIGS. 2 to 6, various examples of the control performed in the controller 40 will be described. FIGS. 2 to 6 show values of the serial number 22, the group data A 24, and the group data B 26 stored in the storage device 20 of the printer 10 and a value of the printer serial number 76 stored in the toner cartridge 70.

Figure 2:
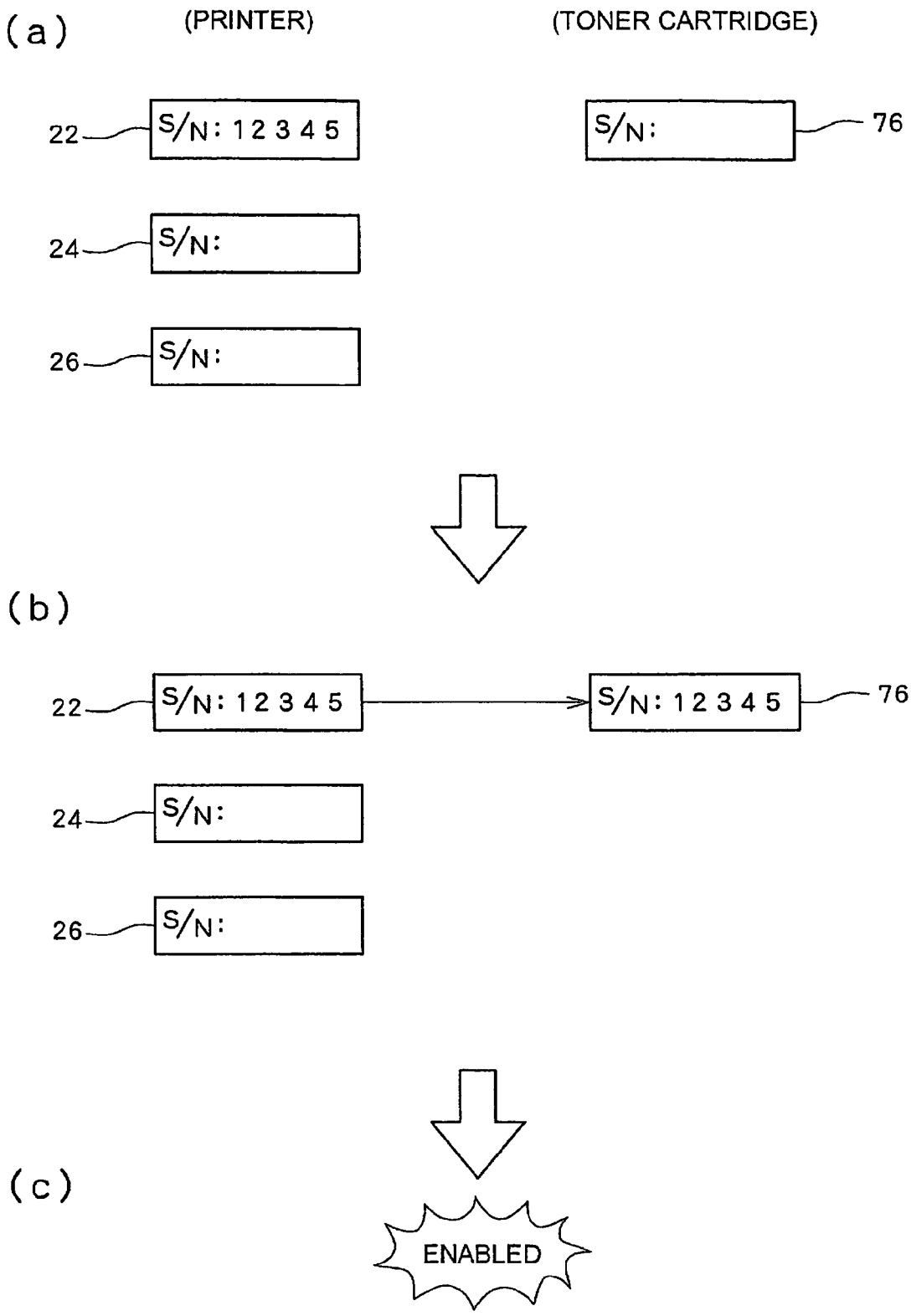
FIG. 2 shows an instance of loading an unused toner cartridge.

FIG. 2 is a diagram showing an instance of loading an unused toner cartridge. Part (a) of FIG. 2 depicts a situation that occurs immediately after the unused toner cartridge is loaded in a printer. Here, a value "S/N:12345" is entered in the serial number 22 of the printer, and no value is assigned to the printer serial number 76 of the unused toner cartridge. Then, as shown in part (b) of FIG. 2, the registration instruction section 46 assigns the value "S/N:12345" of the serial number 22 to the printer serial number 76. In other words, registration is effected such that the toner cartridge is made available in that printer. Subsequently, the approval section 50 enables use of the unused toner cartridge as shown in part (c) of FIG. 2.

Figure 3:
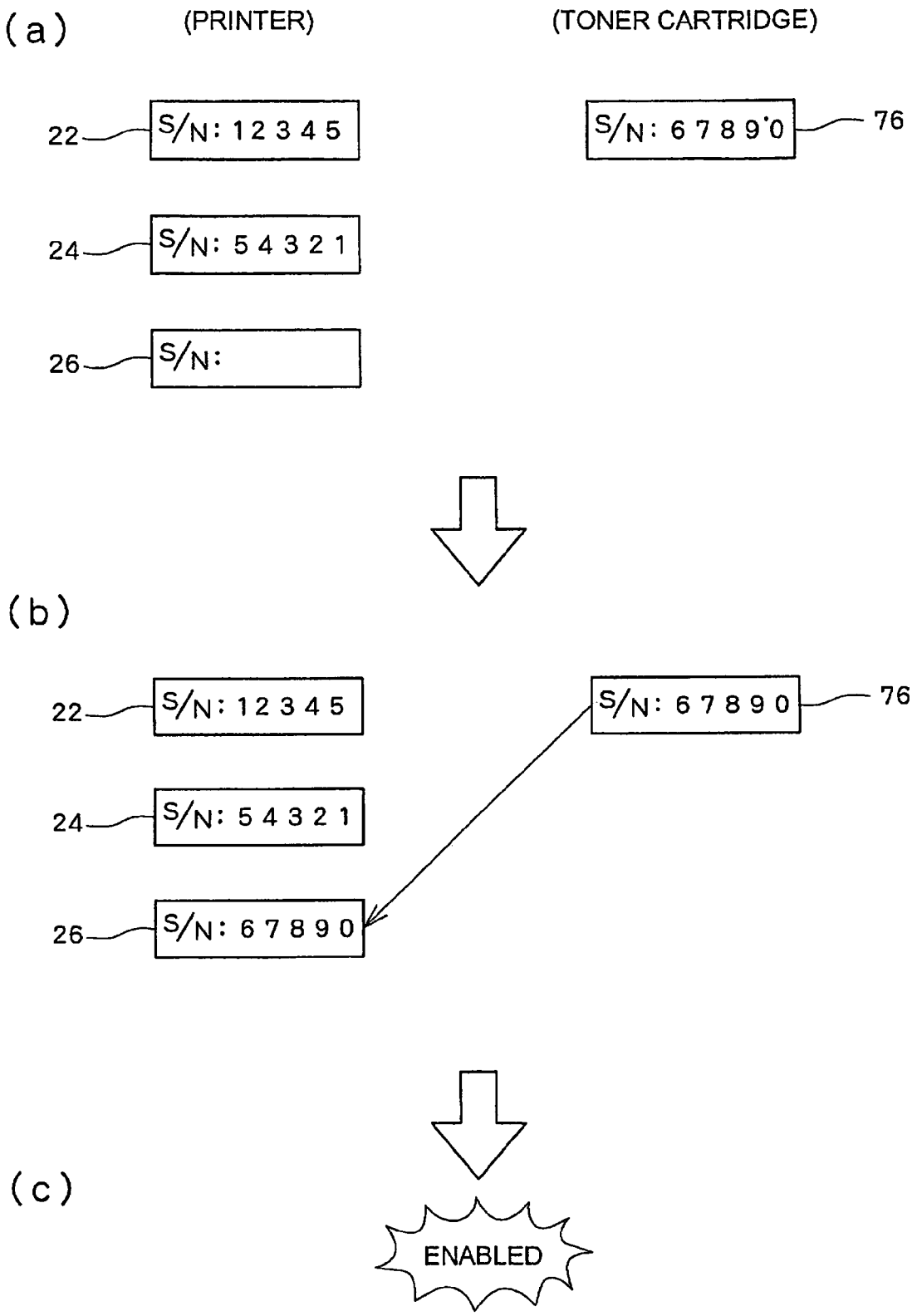
FIG. 3 shows an instance of loading a used toner cartridge.

FIG. 3 is a diagram showing another instance of loading in a printer a toner cartridge which has been used in another printer. Part (a) of FIG. 3 shows a situation that occurs immediately after the used toner cartridge is loaded in the printer. Here, the value "S/N:12345" is entered in the serial number 22 of the printer in which the used toner cartridge is loaded, a serial number "S/N:54321" of a certain printer is entered in the group data A 24, and no value is assigned to the group data B 26. Meanwhile, the printer serial number 76 of the used toner cartridge stores a serial number "S/N:67890" of the another printer in which the toner cartridge has once been used. Thus, at this point, the printer serial number 76 does not correspond to any one of the serial number 22, the group data A 24, and the group data B 26.

Here, the group data B 26 has room for a value to be assigned. Accordingly, the group registration section 48 assigns the value "S/N:67890" of the printer serial number 76 to the group data B 26 as shown in part (b) of FIG. 3. In other words, registration is effected such that the toner cartridge which has been used in the another printer having the serial number "S/N:67890" is made available in the printer having the serial number "S/N:12345" from this time forward. Thus, as shown in part (c) of FIG. 3, the approval section 50 enables use of the loaded toner cartridge.

Figure 4:
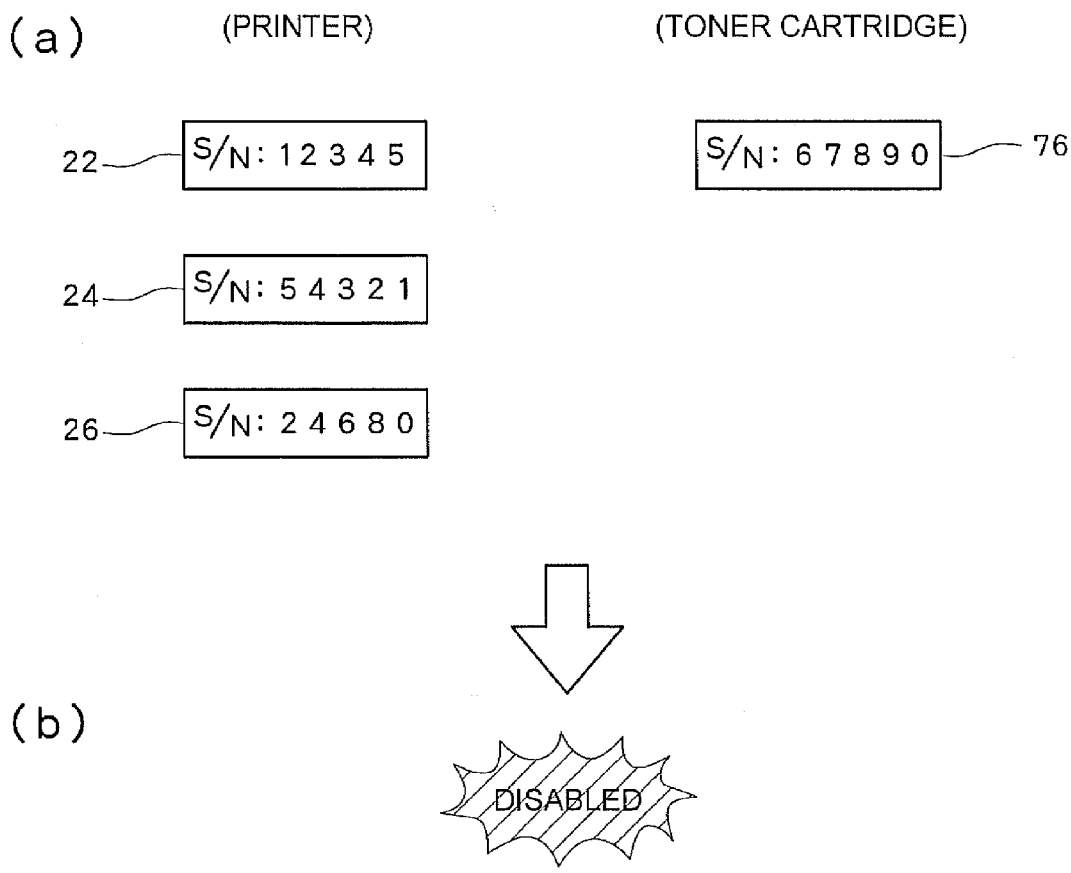
FIG. 4 shows another instance of loading a used toner cartridge.

FIG. 4 shows still another instance, similar to the instance of FIG. 3, of loading in a printer the toner cartridge which has once been used in another printer. In this instance, however, the group data B 26 has already stored a value "S/N:24680" as shown in part (a) of FIG. 4. Accordingly, at this point in time, the printer serial number 76 does not correspond to any one of the serial number 22, the group data A 24, and the group data B 26, and neither the group data A 24 nor the group data B 26 has room for a value to be assigned. Hence, as shown in part (b) of FIG. 4, the approval section 50 disables use of the loaded toner cartridge, which causes the printer to become incapable of printing.

Figure 5:
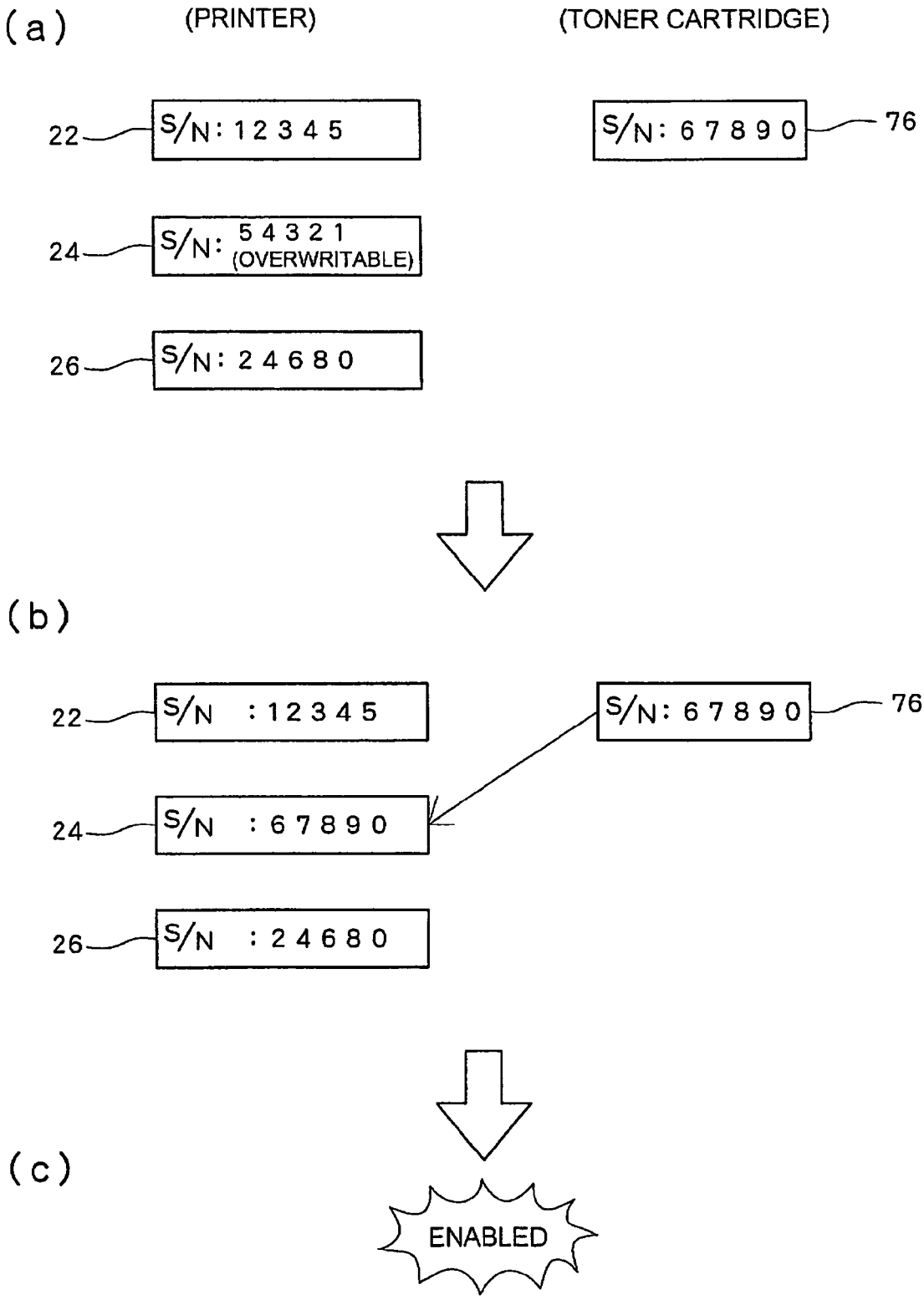
FIG. 5 shows still another instance of loading a used toner cartridge.

FIG. 5 is a diagram showing an instance, similar to the instance of FIG. 4, of loading in a printer the toner cartridge which has been used in another printer. As shown in part (a) of FIG. 5, the group data B 26 has already stored the value "S/N:24680," similar to part (a) of FIG. 4. Accordingly, at this point the printer serial number 76 does not correspond to any one of the serial number 22, the group data A 24, and the group data B 26, and the group data A 24 and the group data B 26 have no room for assignment of a value.

In this instance, as distinct from the other instances, overwriting of the group data A 24 is allowed. Specifically, because a toner cartridge having a printer serial number 76 corresponding to the serial number "S/N:54321" stored in the group data A 24 has not been loaded for a predetermined length of time or longer (for example, for one or two years), the group data A 24 is determined to be unnecessary. Then, as shown in part (b) of FIG. 5, the group registration section 48 overwrites the group data A 24 with the value "S/N:67890" of the printer serial number 76 stored in the loaded toner cartridge. As a result, the approval section 50 enables use of the loaded toner cartridge as shown in part (c) of FIG. 5.

Figure 6:
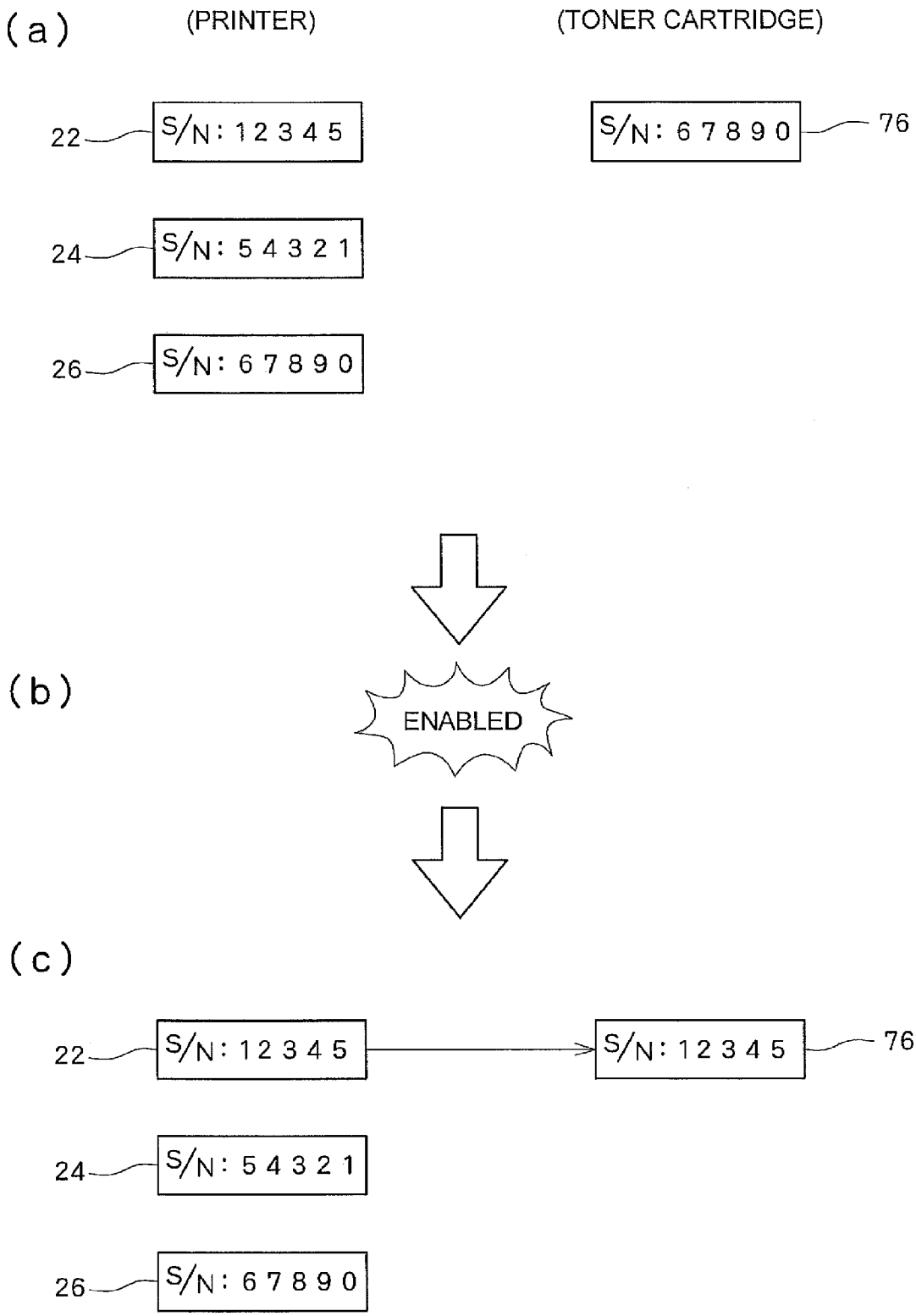
FIG. 6 shows a further instance of loading a used toner cartridge.

FIG. 6 is a diagram showing an instance of reconfiguring availability of the toner cartridge. In this instance, because the value "S/N:67890" of the printer serial number 76 matches the value of the group data B 26 as shown in part (a) of FIG. 6, the approval section 50 enables use of the loaded toner cartridge as shown in part (b) of FIG. 6. Further, in this instance, the registration instruction section 46 overwrites the printer serial number 76 of the loaded toner cartridge with the value "S/N:12345" of the serial number 22.

After the overwriting, availability of the loaded toner cartridge remains unchanged. In contrast, when the overwriting is not implemented, the toner cartridge is still available in the printer having the serial number "S/N:67890" in which the toner cartridge has been initially loaded and in printers grouped into the same group with the "S/N:67890" printer. Therefore, there is a possibility that printers belonging to a group registered in the "S/N:12345" printer in which the toner cartridge is presently loaded (the printers are usually placed in the vicinity of the "S/N:12345" printer) cannot use the toner cartridge. In contrast, when the overwriting is implemented as shown in part (c) of FIG. 6, the possibility that the printers placed in the vicinity of the "S/N:12345" printer can use the toner cartridge becomes higher.

Next, various modifications of the exemplary embodiment will be described. Some portions of the above-described explanation are repeated in the description below.

The image-forming apparatus refers to an apparatus having a function of printing on paper. Examples of such an image-forming apparatus include a printer, a copier (a device having printer and scanner functions), a multifunction machine (a device having various image-processing functions such as a printing function, a scanning function, and a facsimile function), a facsimile, and the like. The printing is not limited to a specific scheme, and various printing methods, such as xerographic printing, ink jet printing, or offset printing, may be adopted. In general, the image-forming apparatus has replacement parts mounted in an easily detachable manner. The replacement parts refer to parts, such as toner cartridges, ink cartridges, drum units, or heating rollers, which are manufactured under the assumption that the parts will be replaced at appropriate timing in view that they are exhausted more quickly than the main body.

A replacement part has a memory configured so as to allow communication with the image-forming apparatus in a wired or wireless manner. In the memory, identification data representing an image-forming apparatus which can use the replacement part may be registered. The identification data may be, for example, inherent data or group data, which will be described below, or data created by converting these data. The image-forming apparatus has inherent data which store information (substantially) inherent in an image-forming apparatus. A serial number or a MAC address may be listed as an example of the inherent data. Further, it is also possible to register, in the image-forming apparatus, group data indicating another image-forming apparatus or a group of other image-forming apparatuses which can share the use of the replacement part with the image-forming apparatus. As the group data, for example, serial numbers or MAC addresses of other image-forming apparatuses, or data representing a name of the group to which the other image forming-apparatuses belong may be used (the image-forming apparatus in which the replacement part is presently loaded may also belong to that group). The name of the group may be, for example, a specific name of the system, a generic name such as a domain name of a network, or the like.

The image-forming apparatus controls whether or not use of replacement part is enabled as described below. The image-forming apparatus initially determines, at a time when a replacement part is loaded or at an appropriate point in time after the loading, whether or not identification data of the replacement part correspond to inherent data or the group data of the image-forming apparatus (in the simplest form, a determination is made as to whether or not there is a match between the identification data, and the inherent data or the group data). When no correspondence is found, in accordance with a registration condition (a requirement for allowing registration as group data) a further determination is made as to whether or not a value of the identification data is registered as the group data. When the registration is determined, the data are registered. Alternatively, when the registration is not determined, use of the replacement part is disabled. On the other hand, when correspondence is found, or when the registration is determined even though no correspondence is found, use of the replacement part is enabled.

In an aspect of the present invention, the image-forming apparatus further includes a registration unit that, when no identification data are registered in the replacement part, registers a value of the inherent data as the identification data in the replacement part. For example, when an unused new replacement part which does not have any identification data registered prior to factory shipment is loaded in an image-forming apparatus, registration is effected such that the unused new replacement part is thereafter used in the image-forming apparatus in which the unused new replacement part is loaded.

In another aspect of the image-forming apparatus according to the present invention, n data items (n is a natural number) may be registered as the group data, and a registration condition is that the number of data items which have already been registered as the group data is equal to (n-1) or smaller. In other words, when there is available space to store an item as the group data, a value of the identification data registered in a replacement part is registered as the group data.

In a still another aspect of the image-forming apparatus according to the present invention, the registration condition is that data which have already been registered as the group data may be rewritten. Further, in another aspect of the image-forming apparatus according to the present invention, whether or not to allow the rewriting of data which have already been registered as group data is determined on the basis of the length of time that has elapsed after registration of the data. For example, when specific group data which were established in the past become useless through a change in the situation, the specific group data are re-established as described above.

In another aspect of the present invention, the image-forming apparatus further includes a registration unit that, when the discrimination unit finds that the identification data registered in the loaded replacement part correspond to the group data rather than the inherent data, registers a value of the inherent data as the identification data in accordance with the determination in the determination unit. Specifically, a usable replacement part is re-established by specifying that the replacement part is to be used in the image-forming apparatus in which the replacement part is presently loaded rather than an image-forming apparatus in which the replacement part has been loaded in the past. In this manner, image-forming apparatuses which can use the replacement part are reorganized into a group relating to the image-forming apparatus in which the replacement part is loaded.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to Best explain the principles of the invention and its practical applications, thereby enabling others skilled in the art to understand the invention for various exemplary embodiments and with various modifications as are suited to the particular use contemplated. It is intended that the scope of the invention be defined by the following claims and their equivalents.

What is claimed is:

1. An image-forming apparatus in which a replacement part is loaded, comprising:

a discrimination unit that determines whether identification data registered in the loaded replacement part correspond to identification data registered in the image-forming apparatus;

a registration unit that, when no correspondence is determined by said discrimination unit, registers in the image-forming apparatus, in accordance with a pre-determined registration condition being met, the identification data registered in the loaded replacement part; and an establishment unit that establishes approval of use of the loaded replacement part when the identification data registered in the loaded replacement part is registered in the image-forming apparatus.

2. The image-forming apparatus according to claim 1, wherein said establishment unit disables use of the replacement part when the identification data registered in the loaded replacement part is not registered in the image-forming apparatus.

3. The image-forming apparatus according to claim 1, wherein a predetermined number of data values can be registered in the image-forming apparatus as identification data, and the pre-determined registration condition is that a number of data values actually registered in the image-forming apparatus is less than the predetermined number of data values that can be registered in the image-forming apparatus.

4. The image-forming apparatus according to claim 1, wherein the pre-determined registration condition is that overwriting of the identification data registered in the image-forming apparatus is allowed.

5. The image-forming apparatus according to claim 4, wherein the allowing of the overwriting of the identification data registered in the image-forming apparatus is determined on the basis of a pre-determined length of time which has elapsed after registering identification data in the image-forming apparatus.

6. The image-forming apparatus according to claim 1, further comprising:

a registration unit, when the discrimination unit determines that the identification data registered in the loaded replacement part correspond to another image-forming apparatus , registers an identification data value of the image-forming apparatus having the loaded replacement part as the identification data in the loaded replacement part.

7. A control method for controlling an image-forming apparatus in which a replacement part is loaded, the control method comprising:

determining whether identification data registered in the loaded replacement part correspond to identification data registered in the image-forming apparatus;

registering, when no correspondence is determined, in the image-forming apparatus in accordance with a pre-determined registration condition being met, the identification data registered in the loaded replacement part; and establishing approval of use of the loaded replacement part when the identification data registered in the loaded replacement part is registered in the image-forming apparatus.

8. The control method according to claim 7, further comprising:

disabling use of the loaded replacement part when the identification data registered in the loaded replacement part is not registered in the image-forming apparatus.

9. The control method according to claim 7, wherein a predetermined number of data values can be registered in the image-forming apparatus as identification data, and the pre-determined registration condition is that a number of data values actually registered in the image-forming apparatus is less than the predetermined number of data values that can be registered in the image-forming apparatus.

10. The control method according to claim 7, wherein the pre-determined registration condition is that overwriting of the identification data registered in the image-forming apparatus is allowed.

11. The control method according to claim 10, wherein the allowing of the overwriting of the identification data registered in the image-forming apparatus is determined on the basis of a pre-determined length of time which has elapsed after registering identification data in the image-forming apparatus.

12. A computer-readable storage medium storing a program causing a computer to execute a process for controlling an image-forming apparatus in which a replacement part is loaded, the process comprising:

determining whether identification data registered in the loaded replacement part correspond to identification data registered in the image-forming apparatus;

registering, when no correspondence is determined, in the image-forming apparatus in accordance with a pre-determined registration condition being met, the identification data registered in the loaded replacement part; and establishing approval of use of the loaded replacement part when the identification data registered in the loaded replacement part is registered in the image-forming apparatus.

13. The storage medium according to claim 12, further comprising:

disabling use of the loaded replacement part when the identification data registered in the loaded replacement part is not registered in the image-forming apparatus.

14. The storage medium according to claim 12, wherein a predetermined number of data values can be registered in the image-forming apparatus as identification data, and the pre-determined registration condition is that a number of data values actually registered in the image-forming apparatus is less than the predetermined number of data values that can be registered in the image-forming apparatus.

15. The storage medium according to claim 12, wherein the predetermined registration condition is that overwriting of the identification data registered in the image-forming apparatus is allowed.

16. The storage medium according to claim 15, wherein the allowing of the overwriting of the identification data registered in the image-forming apparatus is determined on the basis of a pre-determined length of time which has elapsed after registering identification data in the image-forming apparatus.

* * * * *